United States Patent [19]

Harris et al.

[11] 4,135,628

[45] Jan. 23, 1979

[54] HOISTING APPARATUS WITH IMPROVED ANTI-SWAY SYSTEM

[75] Inventors: Rudy M. Harris, Hallsville; Roger L. Wolfe; William T. Martin, both of Longview, all of Tex.

[73] Assignee: Marathon LeTourneau Company, Longview, Tex.

[21] Appl. No.: 890,596

[22] Filed: Mar. 20, 1978

[63] Related U.S. Application Data Continuation-in-part of Ser. No. 731,585, Nov. 12, 1976, abandoned.

[51] Int. Cl.[2] ..... B66C 5/02

[52] U.S. Cl. ..... 212/14; 188/65.3

[58] Field of Search ..... 212/6, 10, 11, 13, 14, 212/12, 15, 16, 17, 18, 19, 20–27, 71, 77, 83, 124–129; 188/65.3; 254/144, 190 R

[56] References Cited

U.S. PATENT DOCUMENTS

| | | | |
|---|---|---|---|
| 3,532,324 | 10/1970 | Crittenden | 212/14 |
| 3,746,182 | 7/1973 | Tax et al. | 212/14 |
| 3,837,503 | 9/1974 | Komatsu | 212/11 |
| 3,899,083 | 8/1975 | Flessner et al. | 212/14 |
| 4,010,948 | 3/1977 | Deluty | 188/65.3 |

FOREIGN PATENT DOCUMENTS

| | | | |
|---|---|---|---|
| 219061 | 2/1968 | Sweden | 212/14 |

*Primary Examiner*—Lawrence J. Oresky
*Attorney, Agent, or Firm*—Vinson & Elkins

[57] ABSTRACT

A movable hoisting apparatus having a pair of spaced apart legs with each leg having two substantially vertical columns, beams extending between the forward columns and the rear columns of each leg, a trolley movable along each of the beams, a lifting frame, sheaves mounted on the lifting frame and trolley sheaves mounted on the trolley, a power drum, a cable extending from the power drum in opposite directions, over the trolley sheaves, downward and around the lifting frame sheaves, upward over the trolley sheaves and forming a crossover portion of the cable between the trolley sheaves and variable brake means retarding the movement of the crossover cable portion to reduce swaying motion of the lifting frame and its load without interfering with the raising and lowering of the lifting frame and load.

6 Claims, 7 Drawing Figures

Fig. 1
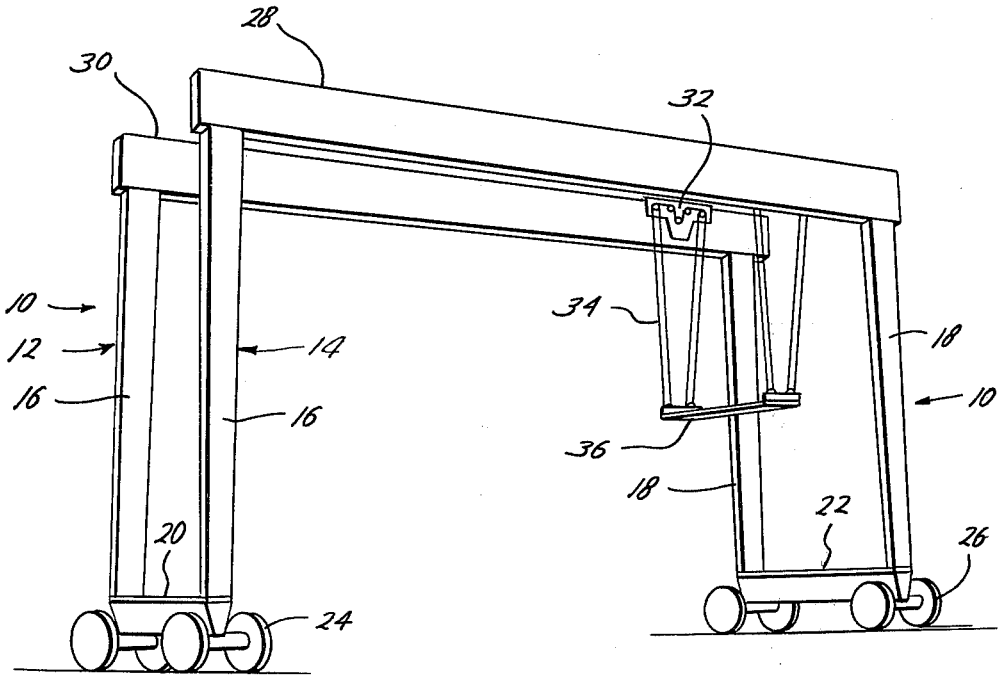
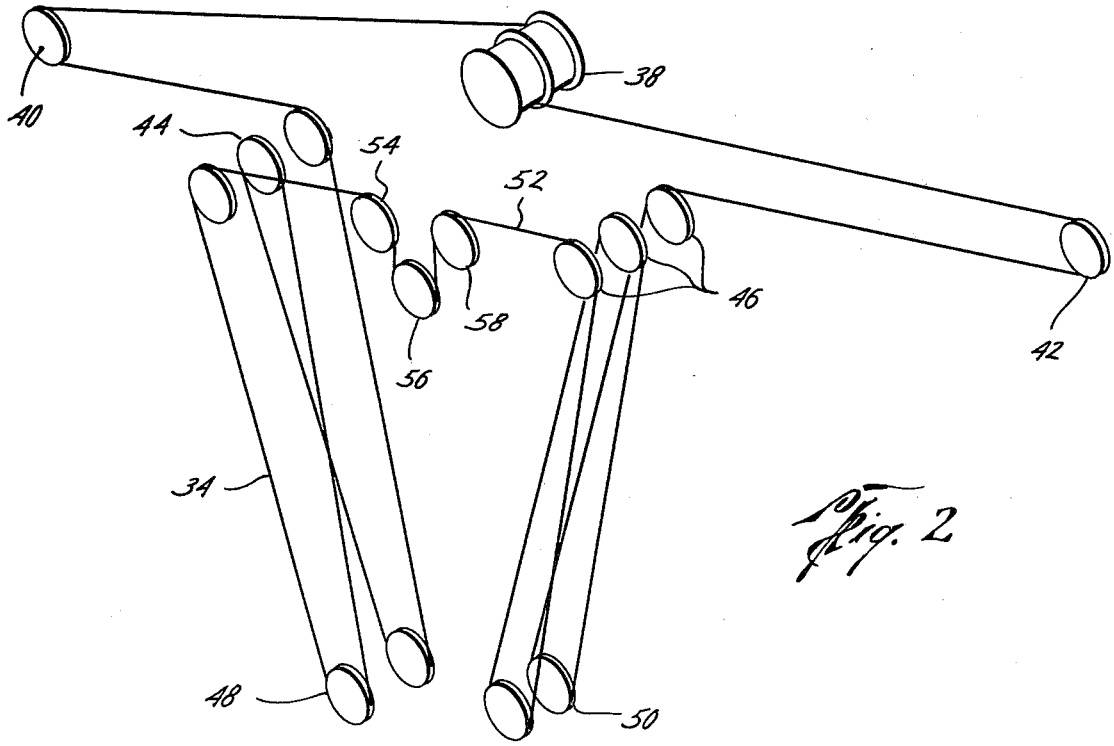
Fig. 2

HOISTING APPARATUS WITH IMPROVED ANTI-SWAY SYSTEM

BACKGROUND OF THE INVENTION

Many types of hoisting devices such as straddle hoists, movable cranes and cranes having movable trolleys mounted thereon, hoist loads by winding cable onto a power drum and lower the loads by unwinding the cable from the power drum. Such devices are subject to the problem of the load swaying when it is moved horizontally while supported by the hoisting device.

In prior apparatus efforts have been made to reduce the sway of loads suspended from the hoisting during hoisting movement. Such efforts have included increasing the distance between the trolley sheaves with respect to the lifting frame sheaves so that the hoisting cables diverge upwardly and thus tend to resist sway (George W. Cooper Patent No. 3,825,128 and A. J. De Stasi U.S. Pat. No. 3,086,661). Also, many patents suggest the use of a separate stablilzing system (see Hans Tax et al U.S. Pat. No. 3,746,182). Others have suggested the use of tag lines (G. H. Crittenden U.S. Pat. No. 3,532,324). Also, these patents result in additional equipment, some of which can increase the sway problems by exerting too much of a return force on the swaying load. Others have involved extensive cable and braking systems.

SUMMARY

The present invention provides an improved anti-sway system for a movable hoisting apparatus.

The hoisting cables diverge upwardly and have a crossover portion which does not move during normal raising and lowering of the load but moves responsive to sway of the load together with a braking system applied to such crossover cable which retards cable movement and thus retards sway of the load.

An object of the present invention is to provide an improved hoisting apparatus with an anti-sway system which is integral with the hoisting reeving without interfering with the hoisting movement.

Another object of the present invention is to provide an improved movable hoisting apparatus having an anti-sway system applied to its cable reeving with a variable braking load therefor.

A further object of the present invention is to provide an improved anti-sway system for the cable reeving of a movable hoisting apparatus which system becomes effective responsive to the commencement of movement of the apparatus.

Still another object of the present invention is to provide an improved anti-sway system for a movable hoisting apparatus which is simple to install and does not appreciably complicate or interfere with the cable hoisting system.

BRIEF DESCRIPTION OF THE DRAWINGS

These and other objects and advantages of the present invention are hereinafter set forth and described with reference to the illustrations of the drawings wherein:

FIG. 1 is a perspective view of the improved hoisting apparatus of the present invention.

FIG. 2 is a schematic perspective view of the cable hoisting system with the improved anti-sway system added thereto.

DESCRIPTION OF THE PREFERRED EMBODIMENT

Figure 3:
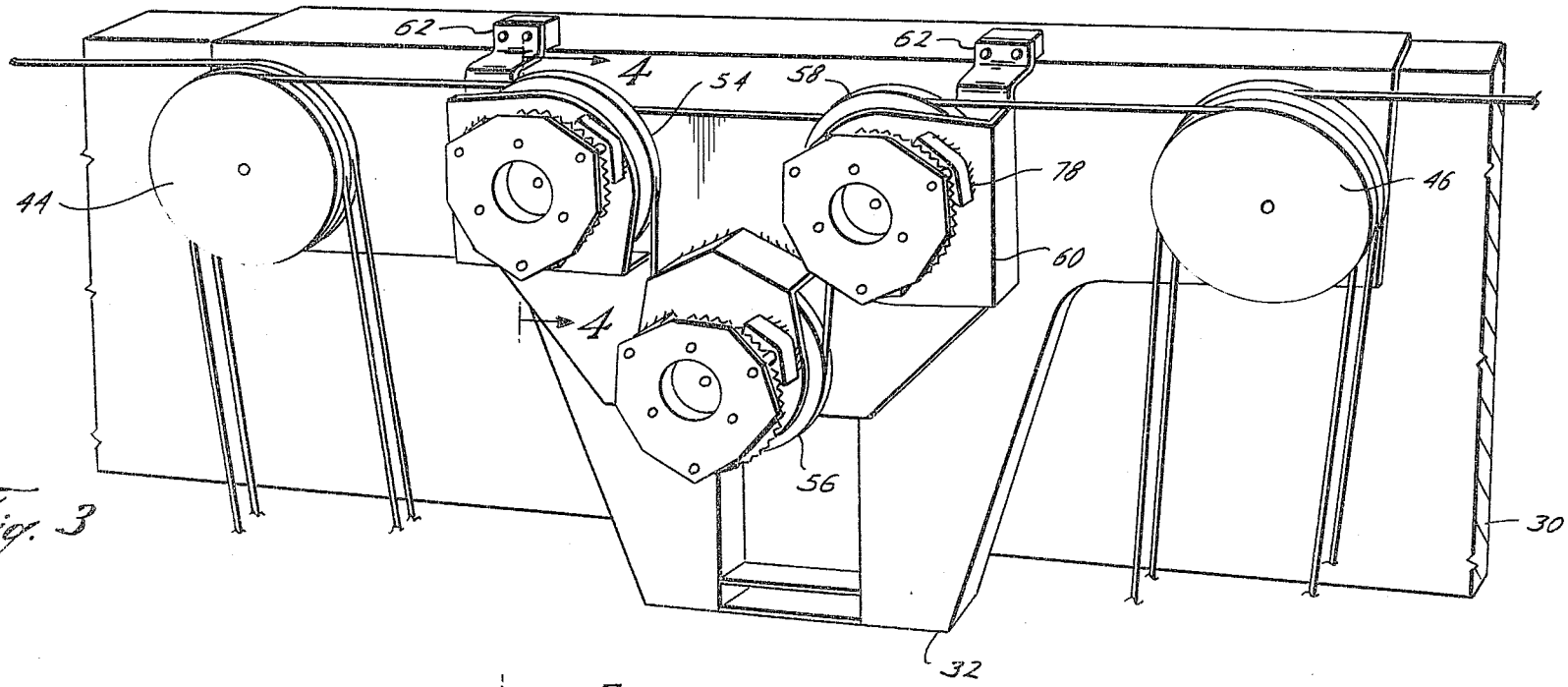
FIG. 3 is an enlarged perspective view of the trolley illustrating the trolley sheaves and the improved brake sheaves of the anti-sway system.
Figure 5:
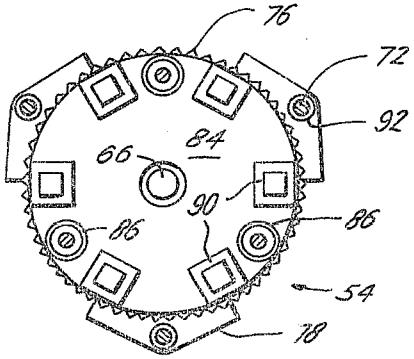
FIG. 5 is a sectional view taken along line 5—5 in FIG. 4.

A hoisting apparatus 10 of the present invention, as shown in FIG. 1, includes two legs 12 and 14 each of which have vertically extending columns 16 and 18. The columns of each leg are joined at their lower ends by the frames 20 and 22 on which the wheels 24 and 26 are mounted. The upper ends of the columns are joined by the beams 28 and 30, as shown. Each beam includes a movable trolley 32 only one of which is shown in FIG. 1. Suspended from the trolley by the cable reeving 34 is the lifting frame 36.

The hoisting apparatus thus is capable of moving on the wheels 24 and 26 and also can move a load supported by the lifting frame 36 transversely between the two legs 12 and 14. Also, the wheels 24 or 26 may be steerable to allow a greater degree of freedom of movement for the hoisting apparatus 10.

The cable reeving system with the improved anti-sway braking of the present invention is most clearly shown in FIG. 2. This system includes the cable reeving 34 which is a continuous cable having both its ends secured to the power drum 38. The cable extends from the drum 38 in opposite directions to the two beam sheaves 40 and 42. From the beam sheaves 40 and 42 the cable extends to the spaced apart trolley sheaves 44 and 46 and is reeved downward around the lifting frame sheaves 48 and 50 and forms the crossover portion 52 between the trolley sheaves 44 and 46.

As can be seen in FIG. 2, the trolley sheaves 44 and 46 are spaced apart a greater distance than are the lifting frame sheaves 48 and 50 so that the cable reeving diverges upwardly. This divergence allows the reeving to apply a correcting force whenever the lifting frame 36 and its load commence swaying. In order to provide a greater retarding force to such swaying, the crossover portion 52 of this cable is engaged by a sway retarding means including the braking sheaves 54, 56 and 58, as shown in FIG. 2. Normal lifting and lowering operations are not disturbed by the sway retarding because the crossover cable portion 52 does not move responsive thereto but only moves responsive to sway of the load.

The movable trolley 32, its sheaves 44 and 46, and the braking sheaves 54, 56 and 58 are best seen in FIG. 3. Since the trolley 32 is movable along the beam 30, the trolley sheaves 44 and 46 are suitably mounted to the trolley 32 in preselected spaced relationship and for movement with the trolley 32. The braking sheaves 54, 56 and 58 are supported from the trolley 32 by the frame 60 which is suitably secured to the trolley 32 as by the fasteners 62.

Figure 4:
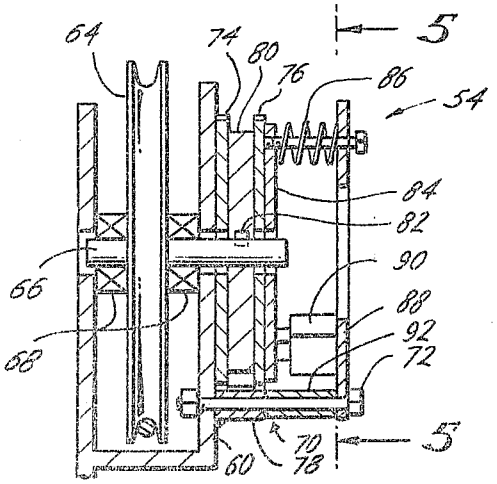
FIG. 4 is a sectional view taken along line 4—4 in FIG. 3 illustrating the details of the improved brake sheave.

Each of these braking sheaves 54, 56 and 58 is similar in that it includes a sheave 64 securely mounted on a shaft 66, as shown in FIG. 4. The shaft 66 is rotatably mounted with respect to the frame 60 by the bearings 68 and extends outwardly through the brake housing 70 which is secured to the frame 60 by the bolts 72. Within the brake housing 70 are positioned a pair of brake discs 74 and 76 having teeth around their exterior which are engaged by the lugs 78 to prevent rotation of the discs 74 and 76. The brake disc 80 is positioned between the discs 74 and 76 and is suitably keyed as by the key 82 to rotate with the shaft 66 and the sheave 64. The pressure plate 84 is urged against the exterior of disc 76 by the springs 86 to provide the axial braking force urging the brake discs together. Supported on the outer ring 88 are the solenoids 90 which connect to the pressure plate 84. When solenoids 90 are activated, they move the pressure plate 84 outward compressing the springs 86 and relieving the braking force between the braking discs 74, 76 and 80. The outer ring 88 is supported from the lugs 78 by the tube 92 which surrounds the bolts 72 and coacts therewith to retain the ring 88 in its desired position.

The braking sheaves may include more than the two braking surfaces shown in FIG. 4 and, thus, additional braking force could be provided with the other two of the braking sheaves. For example, it is preferred that braking sheave 54 has two braking surfaces (as shown) which may develop a retarding force of 60 foot pounds. The braking sheave 58 is preferred to have six braking surfaces which would develop a braking or retarding force of 180 foot pounds and the braking sheave 56 is preferred to have ten braking surfaces which would develop a retarding force of 300 foot pounds. With suitable switching arrangements, the exerted retarding force could be 60, 180, 240, 300, 360, 480 or 540 foot pounds.

The preferred anti-sway control switch would have three positions as follows: Off—all brakes would be released; normal—only sheave brake 54 is set when the twist locks are unlocked and both braking sheaves 54 and 58 are set when the twist locks are locked; and maximum—sheave 54 is set when the twist locks are unlocked and all three sheave brakes are set when the twist locks are locked. It is further desired that the anti-sway brake assemblies be automatically released whenever the trolley assemblies are moved and that they be automatically reset whenever the trolleys being moved come to a stop. The twist locks are the locks which secure the lifting mechanisms to their load. Thus, whenever the load is engaged by the lifting frame 36, the additional retarding force on the crossover portion 52 resists the additional sway forces which develop as a result of the aditional weight of the load. The controls described above may use simple relays and switches as is well known.

Anti-Sway Control System

Figure 6:
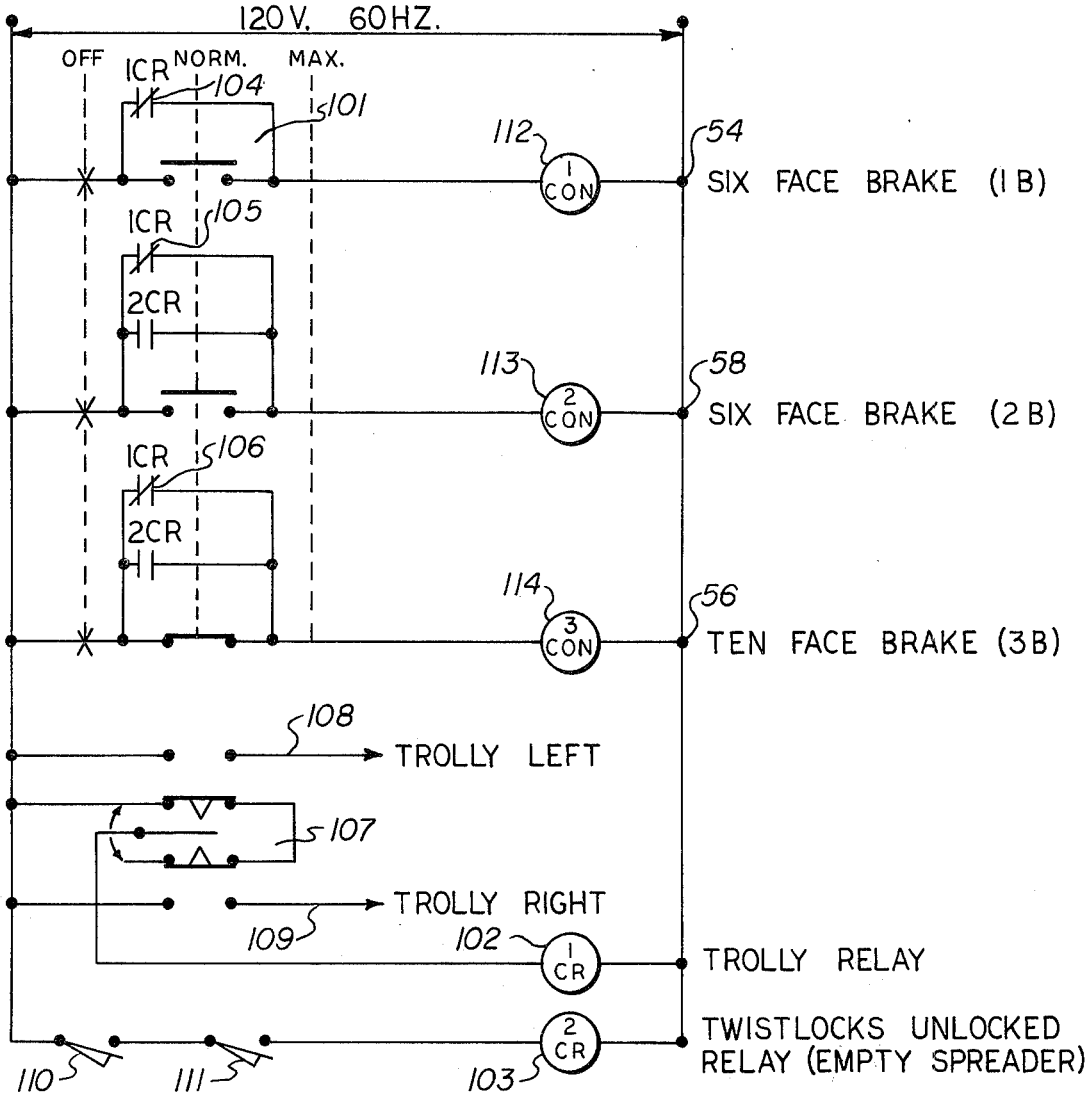
FIG. 6 is a schematic wiring diagram of the anti-sway braking system.
Figure 7:
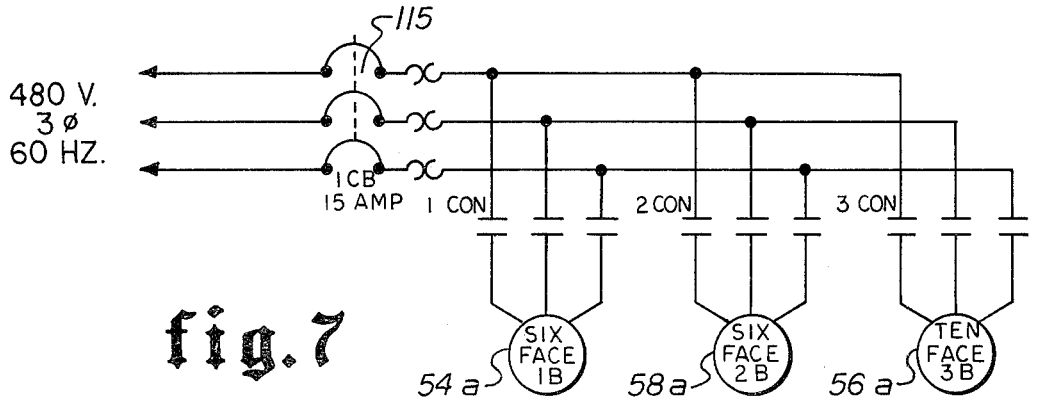
FIG. 7 is a schematic wiring diagram of the brake contactors.

The braking sheaves 54, 56 and 58 are activated by means of the control circuit illustrated in FIGS. 6 and 7. Overall control of the anti-sway system is accomplished by a three-position selector switch 101 and two control relays (1 CR) 102 and (2 CR) 103.

In order to operate the braking system of the invention, the operator selects the desired amount of anti-sway by selecting either Off, Normal or Maximum settings on the selector switch 101. In the Off position contactors 112, 113 and 114 are energized, which releases all brakes 54, 56 and 58. The contactors used by applicant were obtained from Arrow Hart (Catalog No. RC303U), and are 3 pole 600v, 30 amp service.

In the Normal position only 3 CON contactor 114 is continuously energized, which relases brake 56. All brakes are "set" in the Maximum position.

As explained previously, the brakes 54, 56 and 58 are spring "set" and electrically released by means of electrically energized coils or solenoids 90. The brakes are operated by a 480v electrical system.

Since the hoist cable is continuous reeving, the anti-sway sheaves must turn freely when trolleying. This is done through control relay 1 CR, represented at 102, which is controlled by the trolley control switch 107. The CR control relay 102 energizes all contactors 112, 113 and 114, which releases all brakes. If the brakes were not released, their retarding force would have to be overcome by the trolley motor, causing it to be unnecessarily overworked.

When the spreader, or lifting frame 36, is empty (which is sensed by limit switches 110 and 111, the 2 CR control relay 103 energizes contactors 113 and 114. This causes brakes 56 and 58 to be released, brake 54 to remain set, and thereby providing minimum anti-sway.

Consequently, when a load is connected to the lifting frame 36, the twist locks are locked, causing limit switches 110 and 111 to open and the brakes to engage.

Control power is 120v, 1 phase, 60HZ. The line to the brake coils is 480v, three phase, 60HZ. The control relays are manufactured by Allen-Bradley (Catalog No. 700-N400-A1) and are 4 pole, 300v, 10A contact, 120v coil.

FIG. 7 illustrates the wiring for the anti-sway brake coils, having a 15 amp circuit breaker 115 in line with and connected to the anti-sway brake coils 54A, 56A and 58A (referred to hereinbefore as solenoids 90). The circuit breaker 115 used was ITE Catalog No. EF3-B015.

The select switch 101 is preferably a standard micro switch. The limit switches 110 and 111 used by the inventor were Cutter-Hammer Catalog No. 10316-H320. The toggle switch 107 used was Part No. 080-4630 (Marathon-LeTourneau). However, a standard heavy duty, 3 position, spring return-to-center, 20 amp, 120v AC will be satisfactory.

All electrical parts used herein were standard make and may be obtained from the usual sources for same.

What is claimed is:

1. A hoisting apparatus comprising a supporting structure having a substantially horizontal beam and means for supporting the beam in such horizontal position, a lifting frame having means for releasably engaging loads to be moved, a pair of spaced apart lifting frame sheaves supported on said lifting frame, a pair of spaced apart beam sheaves supported from said beam, a plurality of trolley sheaves mounted on a trolley which is mounted on and movable along said beam, said trolley being positioned between said beam sheaves, a continuous cable reeving connecting said drum, said sheaves on said beam, said lifting frame sheaves, said trolley sheaves and forming a crossover portion of said continuous cable between said trolley sheaves whereby rotation of said drum in one direction raises said lifting frame and rotation of said drum in said opposite direction lowers said lifting frame, a plurality of braked sheaves engaging said crossover portion of said continuous cable to retard movement of said crossover portion of said continuous cable, separate and independent brake means for each of said braked sheaves to provide either a zero retarding force or a retarding force of a preselected valve to each of said braked sheaves, and control means to selectively actuate any combination of said brake means such that a combined zero force or any combination of said retarding forces is applied to said braking sheaves.

2. A hoisting apparatus according to claim 1, wherein said sheaves on said trolley are spaced apart a distance greating than said lifting frame sheaves so that the cables extending from the lifting frame sheaves to the trolley sheaves diverge upwardly.

3. A hoisting apparatus according to claim 1, wherein there is included means coacting with said structure for moving said lifting frame in a generally horizontal direction.

4. A hoisting apparatus according to claim 3, wherein said moving means includes wheels on said supporting structure.

5. A hoisting apparatus according to claim 1, wherein each of said braking sheaves exerts a different retarding force on said crossover portion of said continuous cable.

6. A hoisting apparatus according to claim 5, wherein each of said braking sheaves includes at least one rotating and one fixed brake disc, means for exerting a force urging said discs into face-to-face engagement with each other, and means for releasing said force means on said discs.

* * * * *